US006210022B1

(12) United States Patent
Howard

(10) Patent No.: US 6,210,022 B1
(45) Date of Patent: Apr. 3, 2001

(54) ORNAMENTAL LIGHT DISPLAY

(76) Inventor: Graylin Howard, 1010 Dayton Ave., Fort Wayne, IN (US) 46807

( * ) Notice: Subject to any disclaimer, the term of this patent is extended or adjusted under 35 U.S.C. 154(b) by 0 days.

(21) Appl. No.: 09/293,736

(22) Filed: Apr. 16, 1999

(51) Int. Cl.[7] ..... F21V 1/00

(52) U.S. Cl. ..... 362/235; 362/306; 362/810; 362/811; 362/459; 362/498; 362/540; 362/542; 362/281; 362/247

(58) Field of Search ..... 362/235, 806, 362/807, 808, 809, 810, 811, 459, 487, 498, 540, 541, 542, 543, 544, 259, 232, 253, 277, 282, 245, 247, 125

(56) References Cited

U.S. PATENT DOCUMENTS 1,904,901 * 4/1933 Lawrence ..... 362/235
4,250,537 * 2/1981 Roegner et al. ..... 362/806
4,345,395 * 8/1982 Grassi ..... 362/811
4,854,214 * 8/1989 Lowe ..... 362/806
4,972,305 * 11/1990 Blackburn ..... 362/806
4,978,948 * 12/1990 Samen ..... 362/806
5,117,338 * 5/1992 McCrary ..... 362/806
5,555,658 * 9/1996 Yu ..... 362/811

* cited by examiner

*Primary Examiner*—Sandra O'Shea
*Assistant Examiner*—Guiyoung Lee
(74) *Attorney, Agent, or Firm*—Krieg DeVault Lundy, LLP

(57) ABSTRACT

A new and improved lighting display comprising a base having an upwardly facing top surface. The top surface is reflective and has a plurality of spaced apart apertures therein. A light is positioned in each of the apertures such that a light beam from each light shines upwardly away from the reflective top surface. A frame is supported on the base and extends over the apertures. Ornaments are hung from the frame over each of the apertures whereby the light beams may be dispersed by the ornaments during use. In specific embodiments of the invention, light displays for use in motor vehicles as supplemental stop lights and turn signal lights is provided. In other specific embodiments, an ornamental light display is provided for decorative purposes.

26 Claims, 4 Drawing Sheets

ORNAMENTAL LIGHT DISPLAY

BACKGROUND OF THE INVENTION

The present invention relates to an ornamental light display and more particularly to such a display that can be utilized in the rear window of a motor vehicle or on the mantle of a fireplace or other prominent locations in a home or other building for both aesthetic and functional uses.

Ornamental light displays have fascinated some ever since Edison invented the light bulb. Since Edison invented the light bulb a number of different lights have been provided, different light circuitries have been provided in motor vehicles have become common place, and electricity has been used throughout our society. It is therefore highly desirable to provide a new and improved ornamental light display incorporating up-to-date technology.

Additionally, both houses and commercial building have been fully wired such that electrical aesthetic light displays may be utilized for decorative purposes in most all buildings. Decorative light displays add a feature over all other decorative articles inasmuch as their appearance may change dramatically from daylight to night time use and through the use of flashers, lenses, filters, and ornaments and the like may provide a myriad of appearances aesthetically pleasing to nearly all persons. It is therefore highly desirable to provide a new and improved light display which is aesthetically pleasing in both day time use and night time use. It is also highly desirable to provide such an ornament display which can be useful to house clocks, worship centers, or other appliances or to provide occasional lighting for other functions, as desired.

Motor vehicles have also increased in use to the extent that many families have more than one motor vehicle. All motor vehicles are now mandated by Federal and state law to have an electrical system which includes head lights, turn lights, parking lights, brake lights, interior lights, and the like. This lighting system is run by a battery charged by a generator run by the motor vehicle engine. Thus the lighting system can function when the motor vehicle is both functioning and not functioning. Federal and state now mandate that all motor vehicles have stop lights, brake lights, turn signals and they must be suitably positioned at the rear of the vehicle and sized as prescribed. Many persons wish to provide supplement turn signal and brake light indicia through ornamental design to customize their motor vehicle. It is therefore highly desirable to provide a new and improved display that can be operatively connected to the lighting system of a motor vehicle to customize the vehicle. It is also highly desirable to provide a new and improved light display having at least three (3) ornamental lights, one connected operatively to the left hand turn signal, one connected operatively to the right hand turn signal, and one operatively connected to the brake light. It is also highly desirable to provide a new and improved light display for motor vehicles which is aesthetically pleasing to the eye and can be used to customize a motor vehicle both in the day time and in the night time. It is also highly desirable to provide a new and improved light display of the type described for a motor vehicle which can be operated with or without other lights of the vehicle lighting system.

Most recently, lights have evolved in many ways. Various persons have been highly interested in the variable intensity of lights, the various combination of monochromatic lighting, the development of lasers, and various combinations of these technologies. It is therefore highly desirable to provide a new and improved light display which may encompass monochromatic, various combinations of monochromatic and laser lighting systems.

Still others have been highly interested in the way light is dispersed by reflective and refractive devices. Both artists and physicists have been long utilizing prismatic and reflective devices to disperse, bend and transform light sources into a variety of end uses. Particularly significant is the dispersion of lights by crystals. Almost everyone has been enthralled by the dispersion of sunlight on a diamond ring, for example. It is therefore highly desirable to provide a new and improved light display which utilizes reflective and refractive means for enhancing the display. It is also highly desirable to provide a new and improved light display using multifaceted crystalline ornaments for dispersing light.

Finally, it is highly desirable to provide a new and improved lighting display which encompasses all of the above features.

SUMMARY OF THE INVENTION

It is therefore an object of the invention to provide a new and improved ornamental light display incorporating up-to-date technology.

It is also an object of the invention to provide a new and improved light display which is aesthetically pleasing in both day time use and night time use.

It is also an object of the invention to provide such an ornament display which can be useful to house clocks, worship centers, or other appliances or to provide occasional lighting for other functions, as desired.

It is also an object of the invention to provide a new and improved display that can be operatively connected to the lighting system of a motor vehicle to customize the vehicle.

It is also an object of the invention to provide a new and improved light display having at least three (3) ornamental lights, one connected operatively to the left hand turn signal, one connected operatively to the right hand turn signal, and one operatively connected to the brake light.

It is also an object of the invention to provide a new and improved light display for motor vehicles which is aesthetically pleasing to the eye and can be used to customize a motor vehicle both in the day time and in the night time.

It is also an object of the invention to provide a new and improved light display of the type described for a motor vehicle which can be operated with or without other lights of the vehicle lighting system.

It is also an object of the invention to provide a new and improved light display which may encompass monochromatic, various combinations of monochromatic and laser lighting systems.

It is also an object of the invention to provide a new and improved light display which utilizes reflective and refractive means for enhancing the display.

It is also an object of the invention to provide a new and improved light display using multifaceted crystalline ornaments for dispersing light.

Finally, it is also an object of the invention to provide a new and improved lighting display which encompasses all of the above features.

In the broader aspects of this invention, there is provided a new and improved lighting display comprising a base having an upwardly facing top surface. The top surface is reflective and has a plurality of spaced apart apertures therein. A light is positioned in each of the apertures such that a light beam from each light shines upwardly away from the reflective top surface. A frame is supported on the base and extends over the apertures. Ornaments are hung from the frame over each of the apertures whereby the light beams may be dispersed by the ornaments during use.

In specific embodiments of the invention, light displays for use in motor vehicles as supplemental stop lights and turn signal lights is provided. In other specific embodiments, an ornamental light display is provided for decorative purposes.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
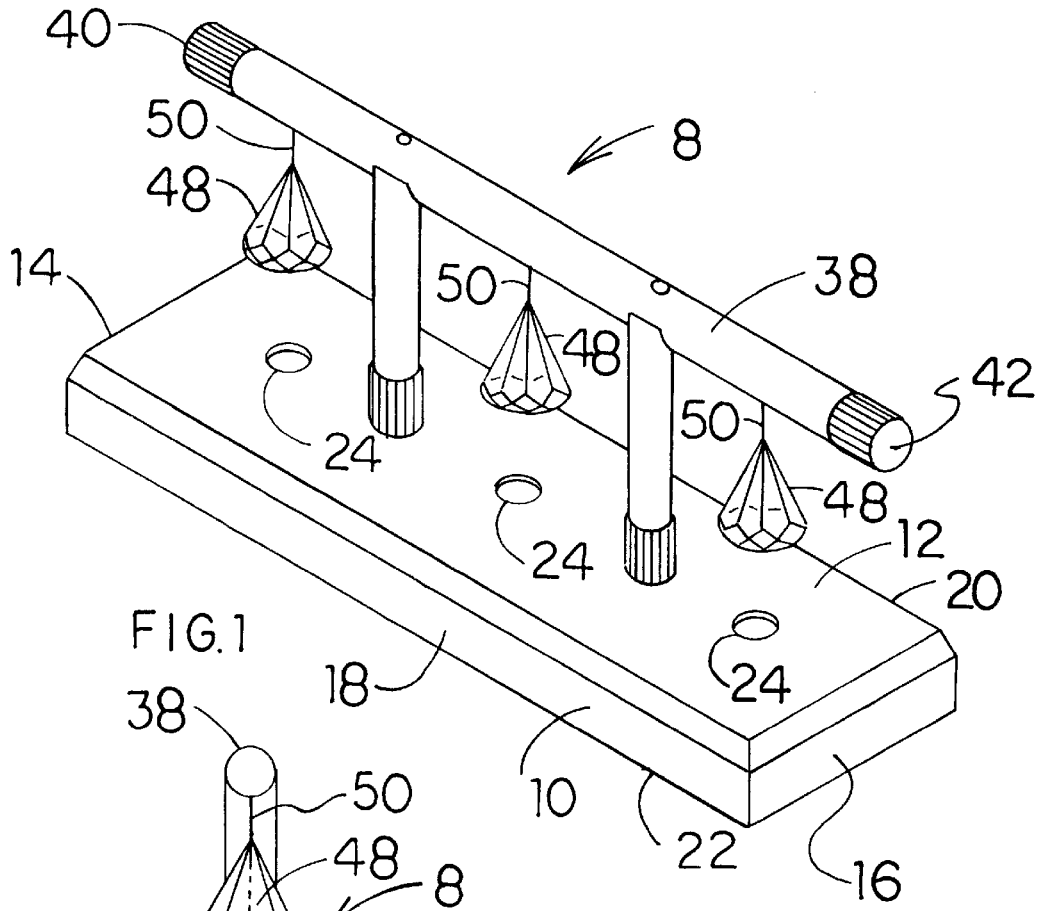
FIG. 1 is a perspective view showing the front end and top and one side of the ornamental light display of the invention including three spaced apart lights and suspended crystal ornaments.

Referring to FIGS. 1–4 and 12, there is shown the new and improved display 8 of the invention to include a base 10 having an upwardly facing top surface 12 opposite ends 14, 16, front side 18, a rear side 20 and a bottom 22.

Top surface 12 has a plurality of spaced apart apertures 24 therein. In each of the apertures 24 there is positioned a light 26 having a directional beam 28 extending upwardly and outwardly away from the top 12. In a specific embodiment these beams 28 extend upwardly in a generally perpendicular direction. Supported on the base 10 is a frame 30. Frame 30 is shown to have two generally vertically extending elements 32 which are secured to the top surface 12 of the base 10 between the three apertures 24 illustrated. These beams 32 have opposite ends 34, 36 and are of generally the same length. End 34 is secured to top surface 12 of the base 10 and end 36 is shown to be spaced apart at the same elevation over the apertures 24. A horizontal frame beam 38 is provided so as to extend over the apertures 24. Beam 38 is secured to end 36 of beams 32. Beam 38 also has opposite ends 40, 42. Ends 40, 42 extend beyond beams 32, but are still positioned over top 12. Thus, beam 38 is shorter than the length of top 12 between opposite ends 14, 16. Similarly, as shown, beams 32 have length which is greater than the height of base 10 between bottom 22 and top 12.

In specific embodiments, base 10 may take a variety of other shapes including a base 10 which is square rather than rectangular, circular, elliptical or any other geometric shape as a length through its center from opposite peripheries longer than the frame 30.

In a specific embodiment, beams 32, 38 may be of any cross sectional shape, have a length of thickness ratio of below 1 to 12 and have an aesthetic exterior design. In specific embodiments, lights 26 may be monochromatic, incandescent lights, candle flames, lasers, or any other light source or combinations thereof. In specific embodiments, apertures 24 may have light filters therein to alter the light beam in any known way, including changing white light to monochromatic light, diffusing light, concentrating light or including lenses for focusing the light of light beams 28 or combinations thereof.

Each of the lights 26 is operatively connected to a connector 44 through a step down transformer 46. The connector 44 may consist of a group of conventional connectors. If the light display of the invention is used in a motor vehicle, connector 44 is attached to the electrical system of the vehicle. In these days, most all motor vehicles have a 12 volt electrical system. Transformer 46 thus would be a step down transformer from 12 volts to the voltage of light 26. Lasers for example operate from 4.5 volts and thus, in the version where lasers are used in an automotive system, transformer 46 would be a 12 volt to a 4.5 volt step down transformer. Similarly, in a motor vehicle where the lights 26 are connected to the brake lights and turn directional lights, connector 44 would be connected to the brake light circuit and the respective right and left turn directional light circuits as desired.

In a specific embodiment in which the display 8 is not utilized in a motor vehicle, connector 44 becomes the connector to either 120 volt or a 240 volt line voltage of the power source, and transformer 46 becomes a step down transformer from the line voltage to the voltage at which the lamps 26 function.

Figure 2:
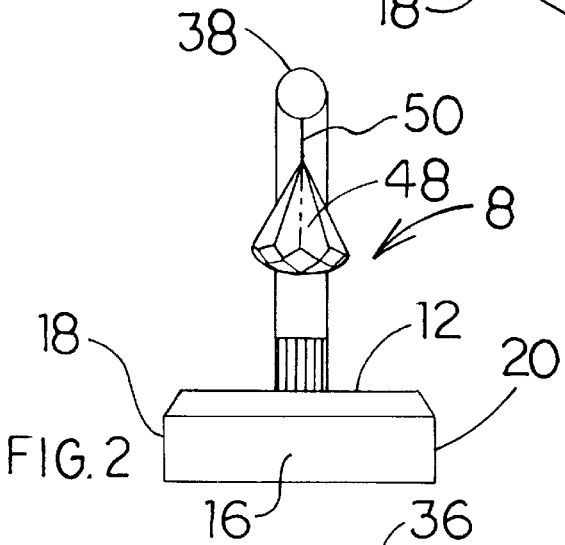
FIG. 2 is a planar end view of the ornamental light display of FIG. 1.
Figure 3:
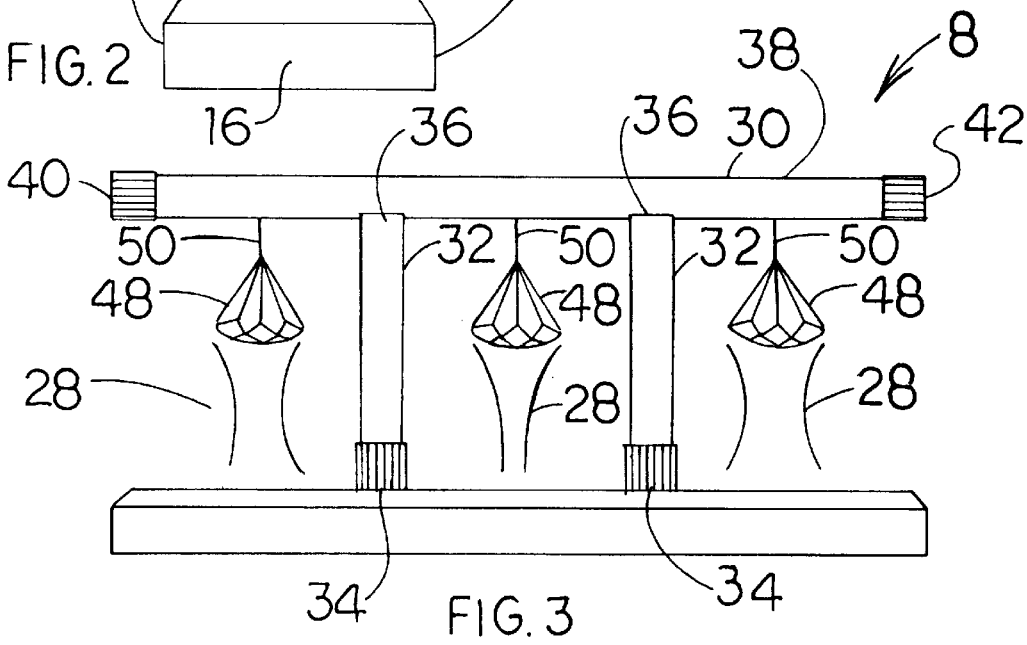
FIG. 3 is a planar side view of the ornamental light display of FIG. 1.
Figure 4:
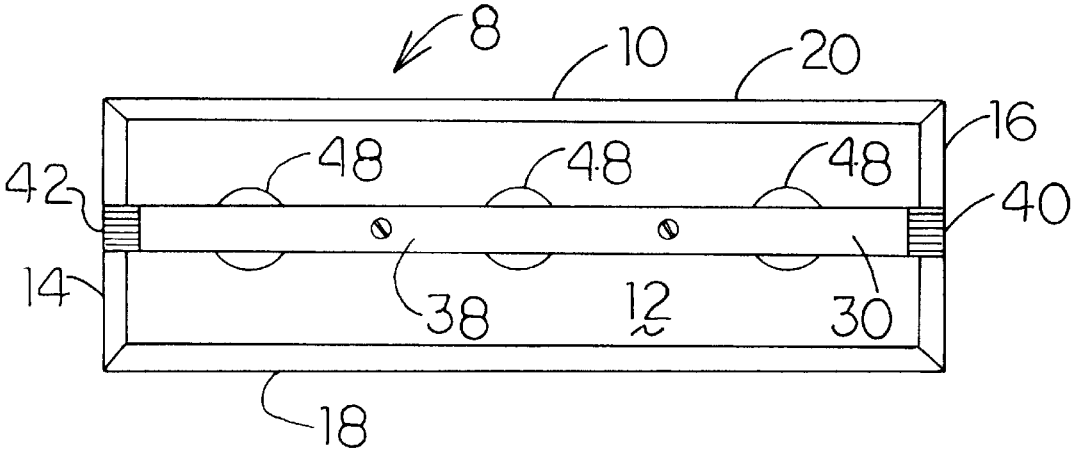
FIG. 4 is a planar top view of the ornamental light display of FIG. 1.
Figure 5:
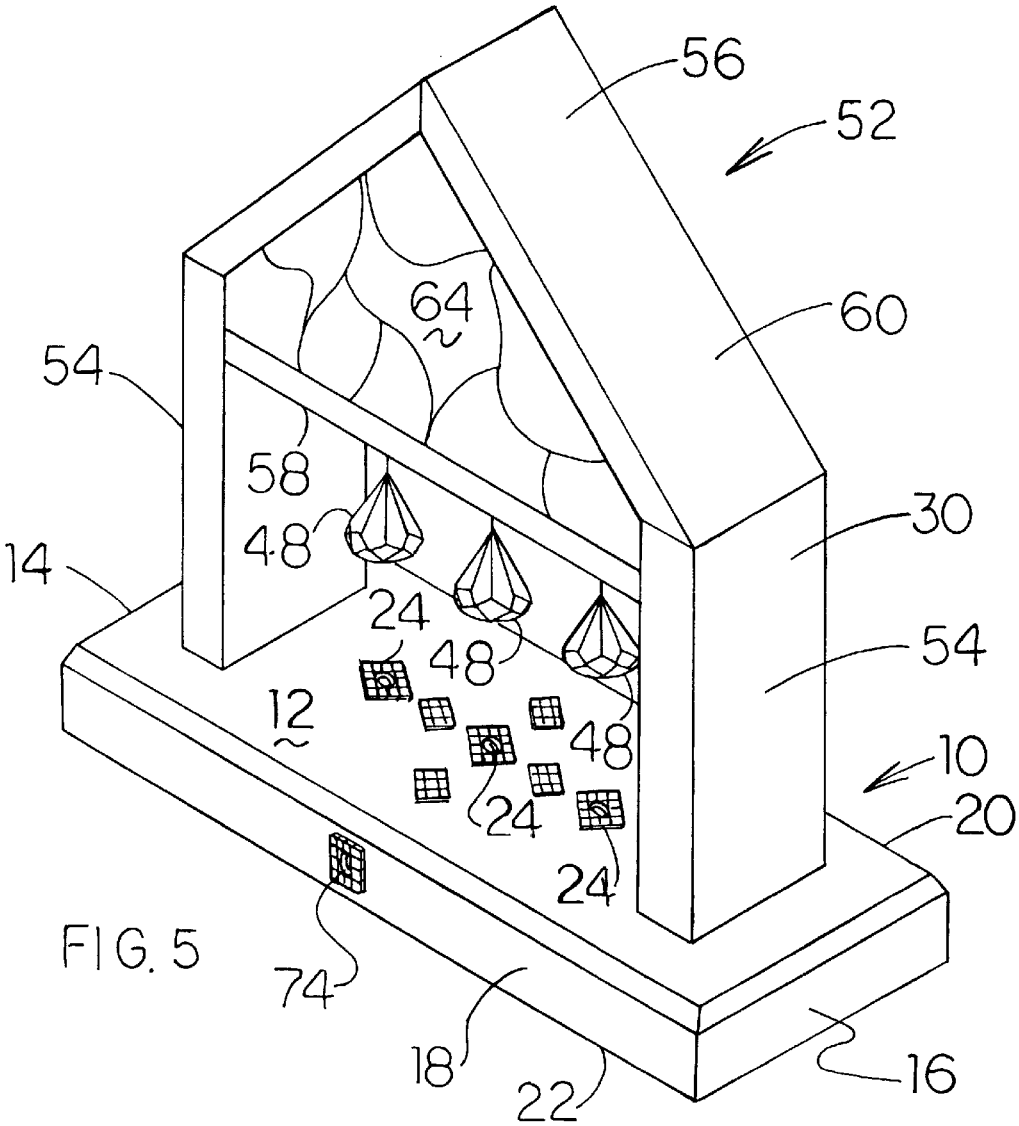
FIG. 5 is a perspective view showing the front end and top and one side view of a modified version of the ornamental display of the invention which has an enclosed frame supported on the base over the apertures.
Figure 6:
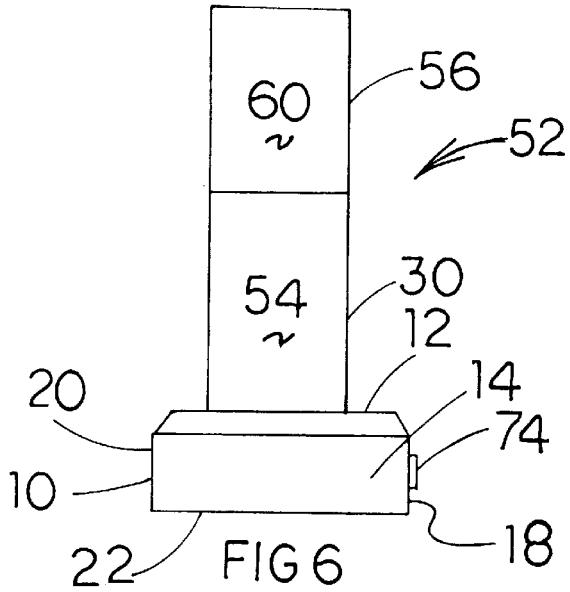
FIG. 6 is a planar end view of the light display of the invention shown in FIG. 5.
Figure 7:
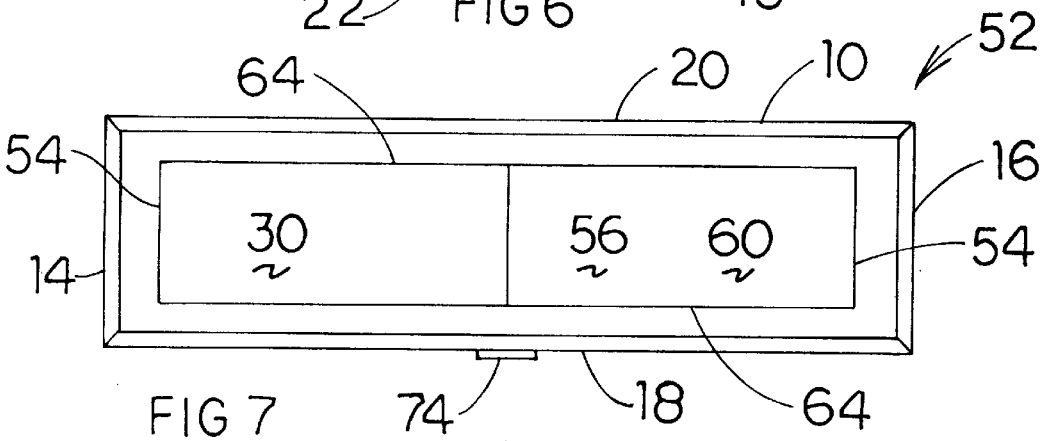
FIG. 7 is a planar top view of the light display of the invention shown in FIG. 5.
Figure 8:
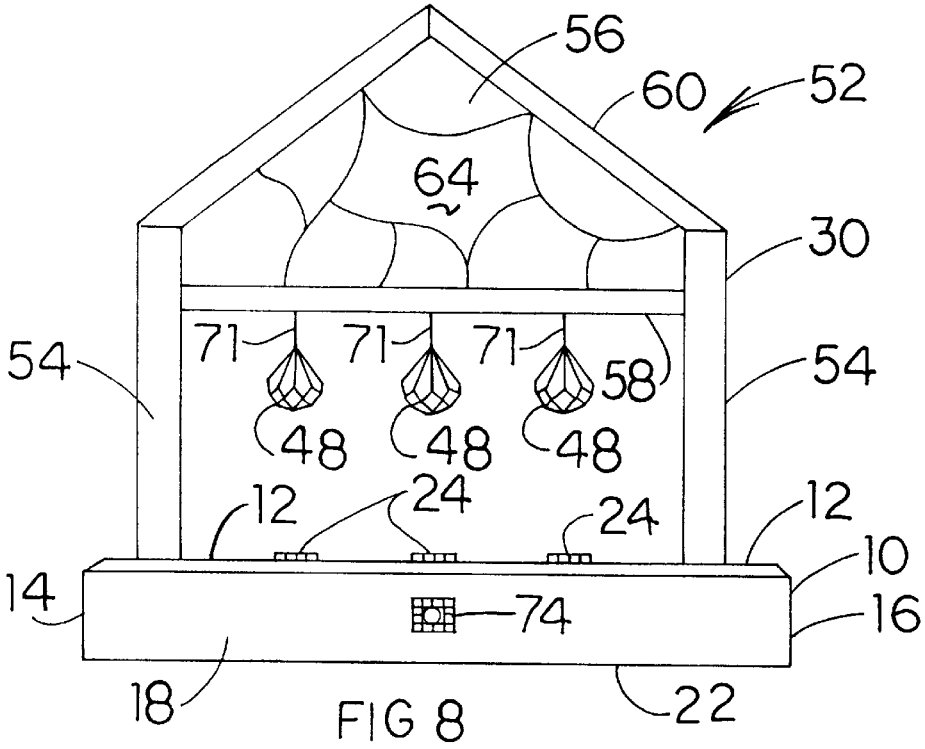
FIG. 8 is a planar side view of the light display of the invention shown in FIG. 5.
Figure 9:
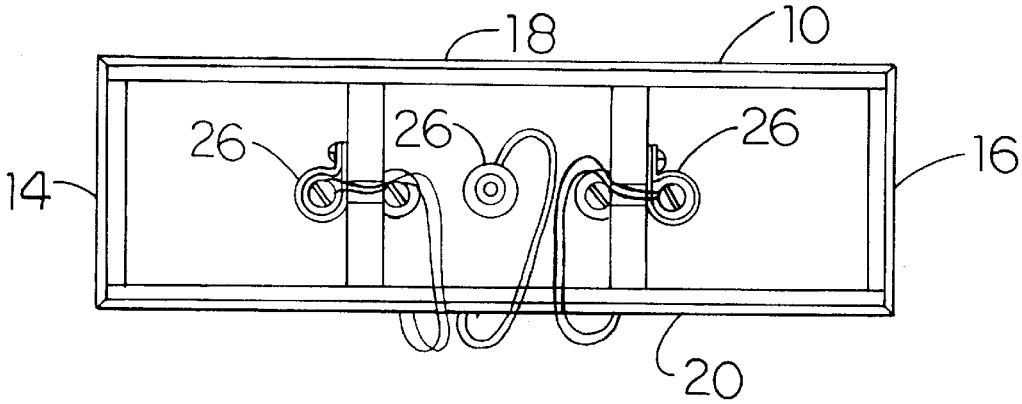
FIG. 9 is a planar bottom view of the light display as shown in FIG. 5.
Figure 12:
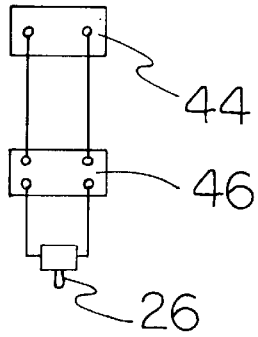
FIG. 12 is a schematic view of the electrical circuitry of the light display of the invention shown in FIGS. 1–4.
Figure 10:
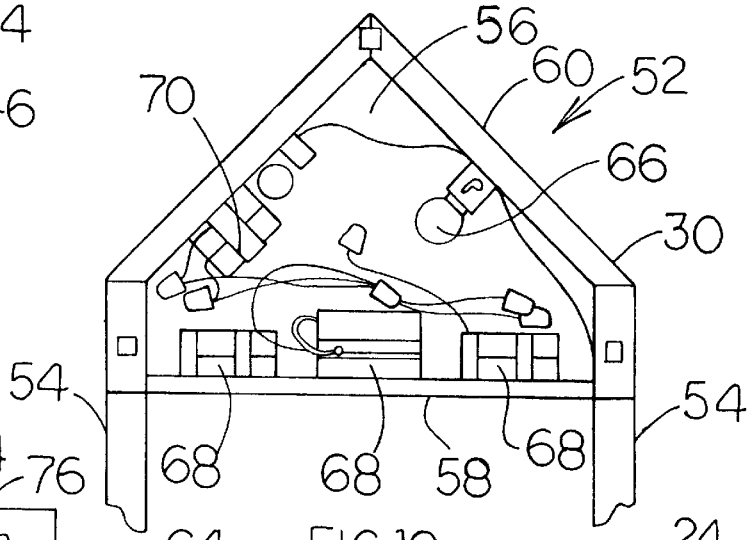
FIG. 10 is a fragmentary rear view of the light display shown in FIG. 5 with the gable side removed showing the interior of the enclosure.

Hanging from the horizontal beam 38 of the frame 30 are a plurality of ornaments 48. Ornaments 48 are hung from horizontal element 38 over the apertures 24 respectively by an element 50 as shown. In specific embodiments, ornaments 48 are positioned within the light beam 28, are hung by cords 50 which are rigid or flexible and chosen from the group of filaments existing of rods, wires, cords, thread, rope, cable, chains, flexible or rigid. Ornaments 48 in specific embodiments may also be of a variety of different ornaments. They may be artistically aesthetic such as Christmas tree ornaments, they may be reflective ornaments, they may be refractive ornaments, they may be multi-faceted reflective and/or refractive ornaments, they may be crystalline ornaments like diamond, zircons, and glass crystals with both multi-faceted reflective faces and refractive faces and may vary in size. In FIGS. 1 through 3 as shown ornaments 48 are three in number with the centrally located ornament 48 being substantially larger than the other two ornaments 48. Depending upon the filament 50 these ornaments may be fixed in position or capable of swinging movement about an at rest position as shown. In other specific embodiments as will be mentioned hereinafter, the ornaments may be rotated as desired about the longitudinal axis of the filaments 50.

Referring to FIGS. 5 through 11 and 13, there is shown a modified version 52 of the new and improved light display of the invention in which like reference numerals are utilized to indicate like elements.

This modified version 52 includes a base 10 having a top 12 and front 18, rear 20 and bottom 22 surfaces and a plurality of apertures 24 in the top surface 12. The base also includes lights 26 having beams 28 extending upwardly from the top 12 of the base 10 and a frame 30 extending over the apertures.

Frame 30 however, is distinctly different from the frame 30 illustrated in FIGS. 1 through 4. Frame 30 in this version partially encloses light beams 28 by having upstanding sides 54 secured to the top 12 outward of the apertures 24 and extending laterally across essentially the entire width of base 10. These sides 54 are shown to extend upwardly of the base 10 a distance similar to beams 32. An enclosure 56 is supported by upstanding sides 54. Enclosure 56 is illustrated as having a bottom 58 and a peek roof-like top 60 secured to the bottom at their longitudinal peripheries 62. The enclosure 56 is enclosed by opposite gable ends 64.

In specific embodiments, enclosure 56 may take a variety of other shapes including rectangular box shapes in which the length of the box extends beyond the walls 50 or between the walls 50 and is aligned with longitudinal axis of base 10 or extending transversely of the longitudinal axis 10, other cylindrical shape, parallelogram shapes, or triangular or frusto triangular shapes, of sizes extending between upstanding walls or sides 54 or extending beyond sides 54 as is desired. In a specific embodiment, one such cylindrical shape would have circular cross-sections extending in planes generally parallel to the longitudinal axis of base 10. In another specific embodiment, enclosure 56 is a sphere supported by sides 54.

In specific embodiments, sides 54 and the exterior surfaces of enclosure 56 and base 10 may take a variety of esthetic forms. In one specific enclosure, the exterior of sides 54 are mirrored as is the top 12, sides 18, 20 and sides 14, 16 of base 10 and the exterior sides of enclosure 56 are mirrored with the exception of the gable ends 64 which are surfaced differently. In a specific embodiment, the gable ends 64 are opaque in nature and illuminated from within enclosure 56. In specific embodiments, gable ends 64 may be of stained glass, leaded construction or may be like esthetically pleasing to the eye sheets of material. In specific embodiments, a decorative clock may be positioned in the center of one of the gable ends 64 or a service club, or fraternal organization indicia or religious indicia, or any other significantly meaningful indicia may be positioned on one of the gable ends 64 in place of the decorative clock.

Figure 13:
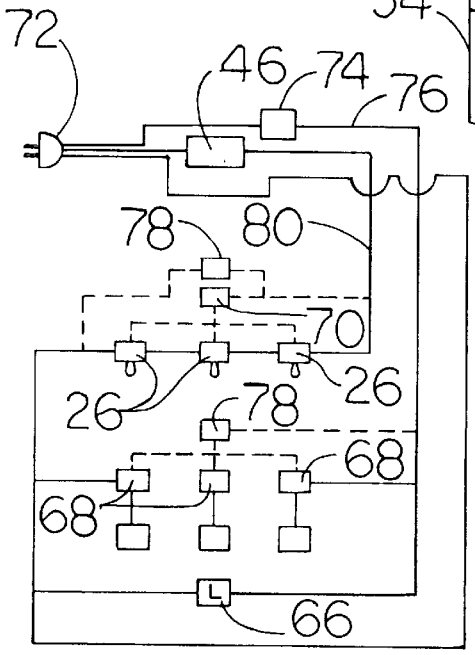
FIG. 13 is a schematic view of the electrical circuitry associated with the modified version of the light display of the invention shown in FIGS. 5–11.
Figure 11:
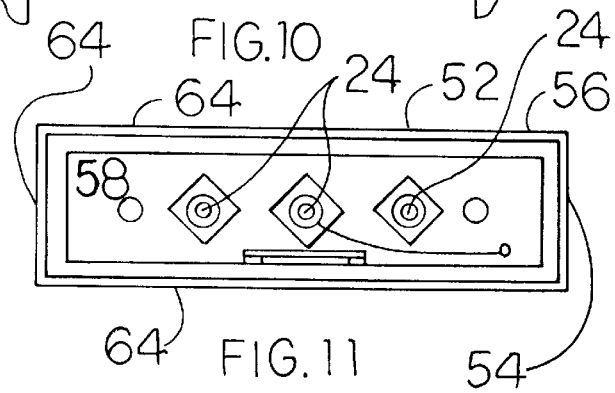
FIG. 11 is a planar bottom view of the enclosure of modified version of the ornamental display of the invention illustrated in FIG. 5.

Enclosed within enclosure 56 is a light 66 and a plurality of motors 68 within which to rotate the ornaments 48. Referring to FIG. 13, the contents of the base 10 and the enclosure 56 will now be described. Enclosed within enclosure 56 is a light 66 and a plurality of motors 68 and a step-down transformer 70. Motors 68 are mounted over each of the apertures 24 and are provided in the same number as the apertures 24. Each of the motors 68 have a motor shaft 71 from which each of the ornaments 48 are hung. The motors 68 when engaged rotate the ornaments 48 in a slow rotation about the vertical axis which is extending upwardly from the apertures 48 coexistent with the axis of the motor shafts. Each of the motors 68 rotate the crystal from which the crystal depending therefrom. In a specific embodiment, the motors rotate each crystal one rotation per minute. Motors 68 are operatively connected to the transformer 70 and to the power source 72 which is contemplated to be either a battery power source or conventional 110 volt or 220 volt alternating currant line source. In a specific embodiment, transformer 70 is in all respects similar to transformer 46 and is a step-down transformer from 110 volt power source to 12 volts from which the lights and the motors operate.

Referring to FIG. 13, the contents of base 10 and enclosure 56 will now be described with reference to the electrical schematic showing the interconnections between the various elements of the invention. Tracing the circuitry from the power source 72 is a power line 76 which extends through the sensor 74 to the transformers 46 and 70 and to the light 66 in the enclosure 56. If a clock 78 is attached to the enclosure, clock 78 as shown by the alternate dash lines is connected directly across the line voltage 72, or in parallel to the motors 68 depending upon the line voltage required by the clock 78. If the clock 78 is driven by 115 alternating currant voltage, the clock is positioned as shown at the middle of FIG. 13. If the clock 78 is driven by a lower voltage, clock 78 is positioned parallel to the motors 68 as shown in the middle of FIG. 13. Motors 68 are shown connected in series to the transformer 74 and in parallel to the lights 26 which are connected in series with the transformer 46. Also connected in parallel with the motors 68 and the lights 26 is the light 66. All are connected in series with the motion sensor 74 when used. In a specific embodiment, the motion sensor 74 is eliminated so that the lights 66, the lasers 26 and the motors 68 and the clock 78 are engaged at all times.

Each of the parallel circuits are then returned to the source 72 by line 80.

In operation, the ornamental light display of FIGS. 1–4 provides an aesthetically pleasing ornamental display. Whenever the display is connected to a power source, the lights 26 are illuminated shining their beams 28 vertically upwardly and generally perpendicularly to the top 12 of the base 10 so as to impact upon the ornaments 48 hung immediately above each of the apertures 24 so as to position the ornaments 48 within the beams 28, respectively. The beams 28 are reflected and refracted by the ornaments 48 and the ornaments 48 are illuminated in a aesthetically pleasing manner such that the reflected and refracted light also is reflected by the surrounding mirrored surfaces. In a specific embodiment, top surface 12, end surfaces 14, 16, side surface 18 and 20 all have mirrors superimposed thereon such that reflected and refracted light from the ornaments 48 reflect from these base 10 surfaces causing an aesthetically pleasing light display.

Whenever the light display is utilized in the back window of a motor vehicle and connected to the electrical system of the motor vehicle, the lights 26 are illuminated as controlled by the electrical circuitry of the motor vehicle. As above described, when viewing FIG. 1, the central light 24 is illuminated whenever the brake lights are lit. The two lights 24 spaced apart by a central light 24 are respectively connected to the left turn signal and the right turn signal light and are illuminated whenever the left turn signal and right turn signal lights are illuminated, respectively. These lights 24 flash as do the tail lights when the turn signals are engaged, and the ornaments 48 swing within the beams 28 of the respective lights as the vehicle swings on its vehicular suspension.

The modified version of the ornamental display of the invention illustrated in FIGS. 5 through 11 function similarly. Similar to the light display illustrated in FIGS. 1 through 4, lights 24 are illuminated whenever power is supplied to them causing beams 28 to be directed upwardly at the ornaments 48 which are positioned within the beams. The ornaments 48 refract and reflect the light on them and the ornaments 48 are illuminated by the beams 28. In a specific embodiment, all of the surfaces of elements 46, 50 and 10 have mirrors superimposed thereon. The light refracted and reflected from the ornaments are reflected by the mirrored surfaces of the enclosure 46, the elements 50 and the base 10. Beams 28, as in the embodiments of FIGS. 1 through 4 above-described, may be varied considerably by whatever filters or lenses are positioned in apertures 24. The variation that can be accomplished by lenses and filters within the apertures 24 are too varied to list here but are well known to those skilled in the art. All known filters and lenses known to the art are contemplated in this invention.

Whenever connected to the power source 72, motors 68 are engaged to rotate the ornaments 48 within the beams 28. Whenever connected to the power source 72, lights 66 illuminate the interior of the enclosure 56 such that any transparent or translucent portion of the enclosure 68 is illuminated for viewing. In a specific embodiment, the sides 64 of the enclosure 58 are illuminated so as to aesthetically present an organizational indicia or a religious symbol or the like. As with the embodiment above in specific embodiments, any of the lights can be flashed instead of steadily illuminated if desired. Further, as described with regard to FIG. 13 alternatively, the power source 72 may be connected to motors 68, lights 26 and lights 66 through a motion sensor 74 if desired.

As can be imagined a person skilled in the art of ornamental light displays, each of the lights 24, each of the motors 68, and the light 66 can be alternatively isolated from the circuit shown in FIG. 13 and/or combined with one or more of the elements shown in FIG. 13 to produce a myriad of aesthetically pleasing different designs. Examples of these displays include rotating the outer two ornaments 48 by motors 66 and maintaining the centrally located ornament 48 stationary, flashing the centrally located light 24 and maintaining the outwardly positioned lights 24 steadily illuminated, flashing light 66 to illuminate the enclosure 56, and any and all combinations or alterations thereof in either the base 10 or the enclosure 56, in either the light display illustrated in FIGS. 1 through 4 or the light display illustrated in FIGS. 5 through 11.

The present invention provides a new and improved ornamental light display incorporating up to date technology which is aesthetically pleasing both during the day and during the night which may take the form of house clocks, worship centers, appliances or occasional lighting as desired. The new and improved light displays of the invention can be operatively connected to the lighting system of a motor vehicle, to serve as auxiliary break light and turn signal lights so as to customize one's motor vehicle, and to provide new and improved light displays utilizing both laser lighting, monochromatic lighting or multicolored lighting as desired. The new and improved invention utilizes both reflective and refractive lighting and aesthetically pleasing illuminated ornaments which may be rotated or otherwise moved within the beams of light to be reflected by adjacent mirrored surfaces or otherwise dispersed to produce the myriad of aesthetically pleasing effects of the displays of the invention.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A display comprising a base of opaque material having a top upwardly facing surface, said base having a plurality of spaced apart apertures therein, a light in each of said apertures, each of said lights having a beam shining upwardly, an opaque frame supported on said base and extending over said apertures, said frame having light reflective surfaces thereon, said reflective surfaces extending generally vertically upwardly from said top upwardly facing surface of said base and generally spaced apart in parallel to said upwardly facing surface of said base over said apertures, an ornament hanging from said frame over each of said apertures between said reflective surfaces and said top upwardly facing surface of said base, whereby said light beams are dispersed by said ornaments and said light reflective surfaces.

2. The display of claim 1 wherein said top surface is light reflective.

3. The display of claim 1 wherein said base is light reflective.

4. The display of claim 1 wherein said apertures are covered with light filters.

5. The display of claim 1 wherein said apertures have lenses therein, said lenses focusing said light beams.

6. The display of claim 1 wherein said lights are lasers.

7. The display of claim 1 wherein said lights are chosen from the group of lights consisting of lasers, incandescent light bulbs, candles, electric arcs, and combinations thereof.

8. The display of claim 7 wherein said lights are monochromatic.

9. The display of claim 1 wherein said ornaments are multifaceted.

10. The display of claim 1 wherein said top surface is light reflective, said lights beams being dispersed by said light reflective surfaces.

11. The display of claim 1 wherein said ornaments are multifaceted crystals.

12. The display of claim 1 wherein said lights are operatively connected to a vehicle light system.

13. The display of claim 12 wherein said lights being three in number arranged in a row with a left light and a right light and a middle light, said left light is operatively connected to a left turn light signal, said right light is operatively connected to a right turn light signal, said middle light is operatively connected to a brake light signal.

14. The display of claim 1 wherein said lights are electric lights, said lights being operative at 4.5 volts.

15. The display of claim 1 further comprising a step down transformer, a switch and a light flasher, said switch and light flasher and step down transformer are operatively connected between said lights and a voltage source.

16. The display of claim 1 further comprising a plurality of spaced apart motors in said frame, each of said motors having a motor shaft, said ornaments being hung from said motor shaft, whereby each of said ornaments may be caused to rotate.

17. The display of claim 16 wherein each of said ornaments rotate about one rotation per minute when said lights are shining.

18. The display of claim 15 wherein said transformer is a 110 volt to a 4.5 volt step down transformer.

19. The display of claim 1 further comprising a motion sensor operatively connected to said lights.

20. The display of claim 19 wherein said motion sensor upon detection of motion turns said lights on for a predetermined period of time.

21. The display of claim 20 wherein said predetermined period of time is greater than 4 minutes.

22. The display of claim 1 wherein said frame is essentially an element extending over said apertures, said element being supported at its opposite ends.

23. The display of claim 1 wherein said frame includes an enclosure extending over said base, said enclosure having a bottom overlying said apertures, said enclosure having opposite upstanding sides, said enclosure having an appliance therein, said appliance having a face on one of said sides.

24. The display of claim 23 wherein said appliance is a clock.

25. The display of claim 23 wherein said enclosure sides are in part mirrored.

26. The display of claim 23 wherein said enclosure sides are chosen from the group of panels consisting of light reflective panels, transparent panels, translucent panels, colored transparent panels, colored translucent panels, stained glass panels, window panels, opaque panels, panels having organizational indicia thereon, wholly or partially in combinations thereof.

* * * * *